US005145087A

United States Patent [19]

Weger, Jr.

[11] Patent Number: 5,145,087

[45] Date of Patent: Sep. 8, 1992

[54] CLOSURE HINGE MECHANISM

[75] Inventor: Kenneth F. Weger, Jr., Cary, Ill.

[73] Assignee: Knaack Manufacturing Company, Crystal Lake, Ill.

[21] Appl. No.: 665,785

[22] Filed: Mar. 7, 1991

[51] Int. Cl.[5] ..... B65D 43/16

[52] U.S. Cl. ..... 220/334

[58] Field of Search ..... 220/343, 334; 16/250, 16/251, 382

[56] References Cited

U.S. PATENT DOCUMENTS

| | | | |
|---|---|---|---|
| 1,699,285 | 1/1929 | Fill | 16/251 |
| 2,049,067 | 7/1936 | King et al. | 16/250 |
| 2,126,050 | 8/1938 | Shiffman et al. | 16/382 |
| 2,200,399 | 5/1940 | Primas | 220/343 |
| 2,726,076 | 9/1956 | Kiba | 220/343 |
| 3,055,535 | 9/1962 | Schneider | 220/334 |
| 3,319,697 | 5/1967 | Krohn | 16/250 |
| 3,477,091 | 11/1969 | Gordon | 220/334 |
| 4,471,881 | 9/1984 | Foster | 220/334 |
| 4,878,267 | 11/1989 | Roach et al. | 16/250 |
| 5,001,862 | 3/1991 | Albenda | 16/251 |

FOREIGN PATENT DOCUMENTS

| | | | |
|---|---|---|---|
| 3230369 | 2/1984 | Fed. Rep. of Germany | 16/250 |
| 50880 | 11/1966 | German Democratic Rep. | 220/334 |
| 6401417 | 8/1965 | Netherlands | 220/334 |
| 339813 | 12/1930 | United Kingdom | 16/251 |
| 421758 | 12/1932 | United Kingdom | 16/250 |

OTHER PUBLICATIONS

American Van Equipment Catalog 40, pp. 1, 20–22, 24 and 32, Jan. 1990.

Pickup Truck Accessories brochure, Reading Body Works, Inc., 1985.

*Primary Examiner*—Stephen Marcus
*Assistant Examiner*—S. Castellano
*Attorney, Agent, or Firm*—Leydig, Voit & Mayer

[57] ABSTRACT

A storage box that is both rust and tamper resistant. The box includes a body and a cover that are coupled together by a hinge along the upper rear edge of the box. The rear wall of the cover is "V" shaped, extending downward along the outside of the box, then bending toward the inside of the box and extending upward. The cover is secured to the hinge by rivets that extend through the outer arm of the hinge and the inner portion of the rear wall of the cover, such that the heads of the rivets are neither visible nor accessible from the outside of the box. The hinge is fabricated from stainless steel and the cover and the body are both treated with a rust resistant coating.

19 Claims, 4 Drawing Sheets

CLOSURE HINGE MECHANISM

FIELD OF THE INVENTION

This invention relates generally to storage boxes and, more specifically, to hinge assemblies for coupling the cover to the body of the storage box.

BACKGROUND OF THE INVENTION

Industrial storage and utility boxes are often used in environments where they are accessible by the public and may be exposed to elements of foul weather. Consequently, such boxes must be both tamper resistant and weather resistant.

The hinge assemblies of boxes are particularly susceptible to tampering. In many commercially available storage boxes, the hinge itself is exposed to the outside of the box along one side. Consequently, an intruder may gain access to the box by prying the exposed hinge apart to separate the cover from the body of the box.

Further, certain previously-used approaches for coupling a hinge to a box are likewise susceptible to tampering. For example, if the hinge is coupled to either the cover or the body of the box by rivets that are exposed to the outside of the box, an intruder may pop off or pry open the rivets to gain access to the box. In order to eliminate this problem, the hinge in many prior art units has been coupled to the box by welding.

Welding the hinge to the cover and/or body of the box, however, decreases the resistance of the box to weather damage (i.e., rusting), since adjacent surfaces must be clean and free of coatings in order to provide weld integrity. Consequently, the welded components may only be treated to resist rust after they have been assembled and welded.

Storage boxes are generally treated to resist rust by applying paint or some other rust resistant coating to the surfaces of the cover, body, and hinge. If the paint or other rust resistant coating is applied to the surface after assembly, it is generally impossible to apply the paint to adjacent, welded surfaces. As a result, these surfaces will have little or no resistance to rust.

Further, this method of manufacturing can be costly and time consuming. Welding the components together is expensive and requires a large capital equipment investment. Additionally, the application of paint or other coatings after assembly of the box is quite cumbersome and requires excessive handling.

SUMMARY OF THE INVENTION

It is a primary object of the invention to provide a tamper and rust resistant storage box. A related object is to provide a hinge assembly that resists rust, yet is substantially impervious to intruders.

Another object is to provide a storage box wherein the components may be treated for rust resistance prior to assembly.

A more detailed object is to provide a hinge assembly having the hinge coupled to the box by means other than welding.

An additional object is to provide a storage box wherein the hinge assembly is substantially concealed from external access and view.

Other objects and advantages of the invention will be apparent from the following detailed description.

In accomplishing these objectives in accordance with the invention, there is provided a storage box having a body and a cover that are treated with rust resistant coating. The body and cover are coupled together along one side by a hinge. One wall of the cover extends downward and inward from the top of the cover toward the hinge side of the box, and then angles upward, thus forming a "V" shaped channel having inwardly and outwardly disposed sections. A hinge having two pivotable arms and being preferably formed from a rust resistant material, such as stainless steel, is used to couple the cover to the box. One arm of the hinge is coupled to the inwardly disposed section of the cover wall, and the other arm of the hinge is coupled to the body of the box. These elements are preferably coupled together by mechanical means, such rivets or screws.

The unique design of the cover wall permits the utilization of rivets or screws, to secure the components of the box together. Because the rivets are not exposed to the outside of the box, the box is resistant to tampering. The box is further resistant to tampering since the hinge is disposed so that it is substantially sandwiched between the walls of the body and cover, rather than being largely exposed to the outside as in prior art storage boxes.

Additionally, due to the unique cover design and the shielding of the hinge, the box is substantially impervious to rain and other elements of foul weather. Moreover, since the components are secured together by rivets, rather than welds, both the body and the cover may be thoroughly coated with a rust resistent coating prior to assembly. As a result, the storage box is highly resistant to rust. The hinge itself is either made of rust resistant stainless steel, or, if not, may also be coated with a rust resistant coating prior to riveting.

DETAILED DESCRIPTION OF THE PREFERRED EMBODIMENTS

While the invention will be described in connection with certain preferred embodiments, it will be understood that it is not intended to limit the invention to those particular embodiments. On the contrary, it is intended to cover all alternatives, modifications, and equivalents as may be included within the spirit and scope of the invention as defined by the appended claims.

Figure 1:
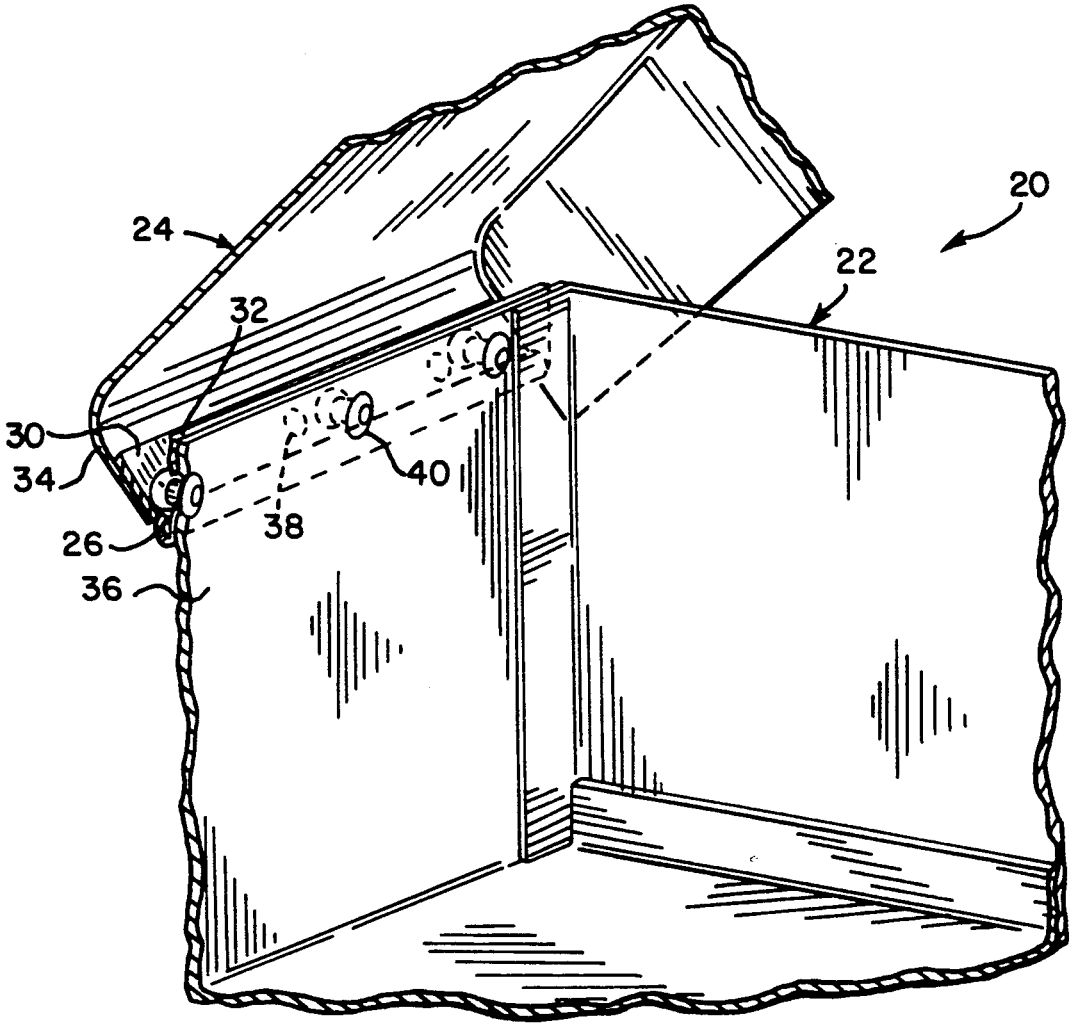
FIG. 1 (PRIOR ART)
FIG. 1 is a fragmentary view of an inside rear corner of a storage box constructed in accordance with the prior art.

Turning now to the drawings, FIG. 1 shows a fragmentary view of an inside rear corner of a prior art industrial storage box 20 having a body 22 with a cover 24 coupled to the upper rear edge of the body 22 by a hinge 26. While this prior art storage box 20, as well as the storage box **20*a* constructed in accordance with the invention, will be described as embodiments in which the cover is hinged to the body 22** along the upper rear edge of the box, it will be appreciated that the cover could, in the alternative, be hinged along either an upper side edge or upper front edge.

Figure 2:
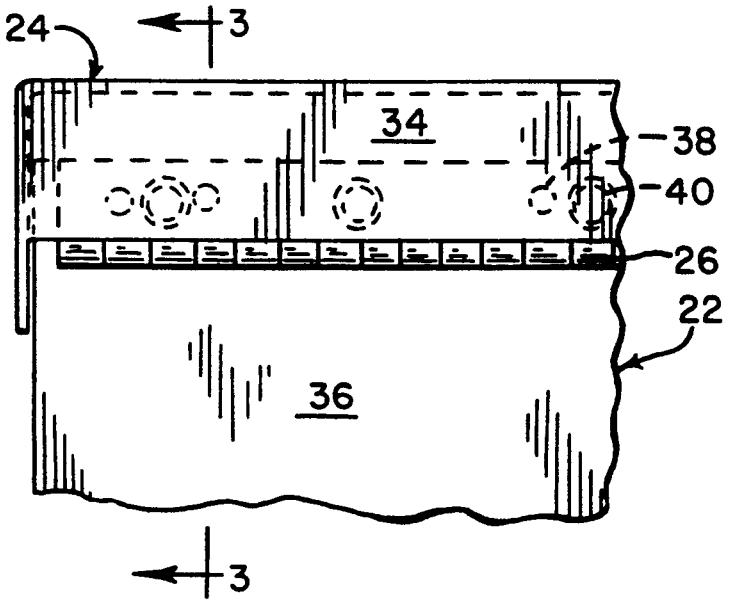
FIG. 2 (PRIOR ART)
FIG. 2 is a fragmentary rear view of the prior art storage box of FIG. 1 in a closed position.
Figure 3:
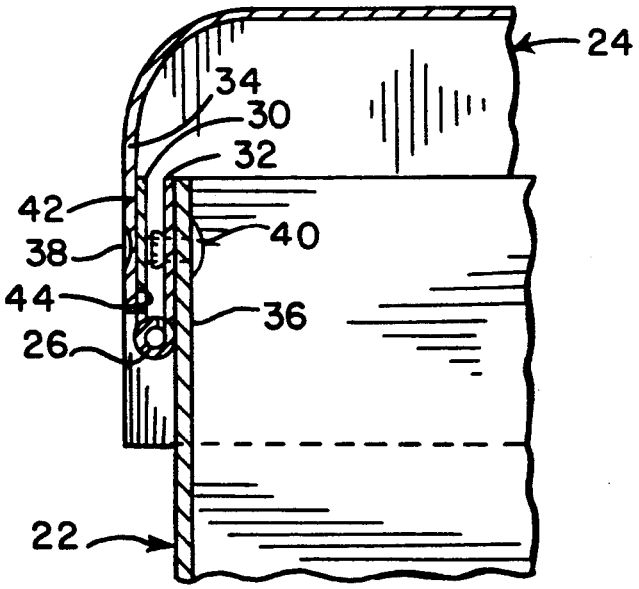
FIG. 3 (PRIOR ART)
FIG. 3 is a fragmentary cross-sectional view of the prior art storage box taken along line 3—3 in FIG. 2.

The hinge 26 comprises two pivotable arms 30, 32, which are secured to the rear wall 34 of the cover 24 and the rear wall 36 of the body 22, respectively, by fastening means 38, 40. The fastening means 40 is accessible only from the inside of the box, and, therefore, is not generally susceptible to tampering. Accordingly, the inner arm 32 of the hinge 26 may be secured to the rear wall 36 of the body 22 of the box 20 by any suitable means (such as rivets 40, as shown in FIGS. 1-3).

In contrast, the fastening means 38 are disposed along the outside of the box 20, i.e., along the rear wall 34 of the cover 24. Therefore, it will be appreciated that certain fastening means 38 (such as rivets) for connecting the outer arm 30 of the hinge 26 to the rear wall 34 of the cover 24 must be exposed to the outside of the cover and are quite susceptible to tampering. An intruder could readily pry the cover 24 and break the rivets to gain access to the inside of the box 20.

To eliminate this problem, the outer hinge arm 30 in prior art boxes has, generally, been secured to the cover wall 34 by welding the components together. In order to attain good weld integrity, the adjacent, welded surfaces 42, 44 must be clean and free of any coatings. Of course, it is desirable that a metal storage box be rust resistant, and, therefore, a rust resistant coating, such as paint, has typically been applied after the cover 24 and the hinge 26 have been welded together. It will be readily appreciated, however, that when a coating is applied after the components 24, 26 have been welded together, the coating may not be effectively applied to all surfaces. For example, the coating will not reach between the adjacent surfaces 42 44 that have been welded together. As a result, the rear wall 34 of a cover 24 and the outer ar 30 of hinge 26 that have been welded together in accordance with the prior art are particularly susceptible to rust.

Figure 4:
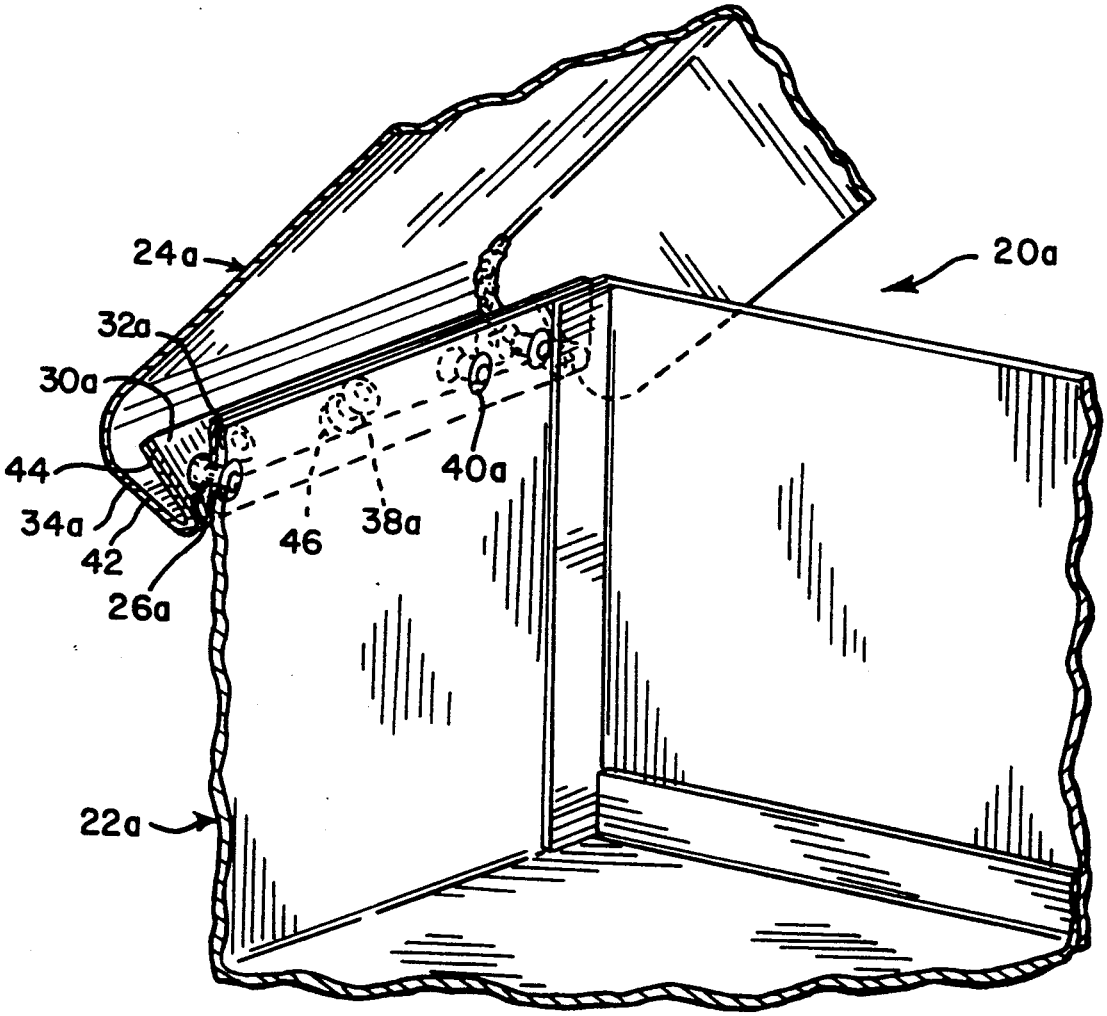
FIG. 4 is a fragmentary view of an inside rear corner of a storage box constructed in accordance with the invention.
Figure 5:
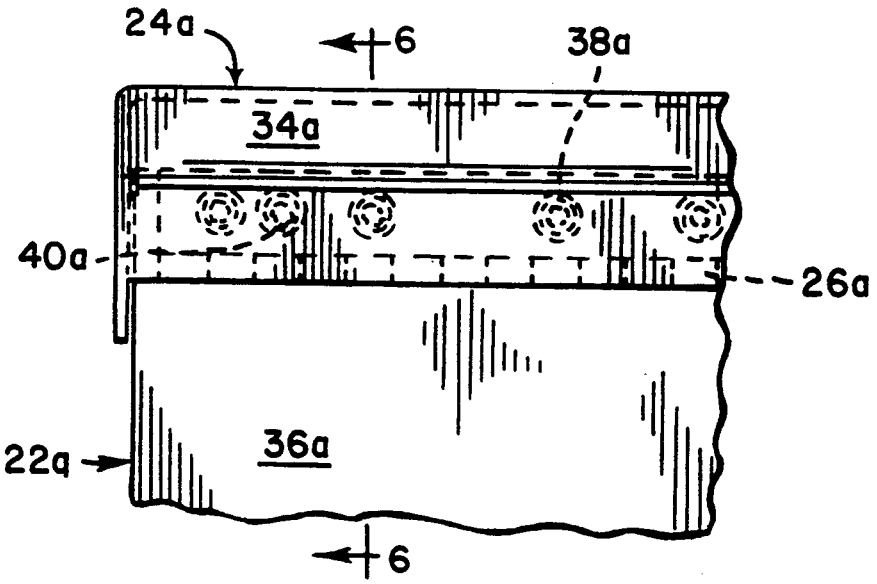
FIG. 5 is a fragmentary rear view of the inventive storage box of FIG. 4 in a closed position.
Figure 6:
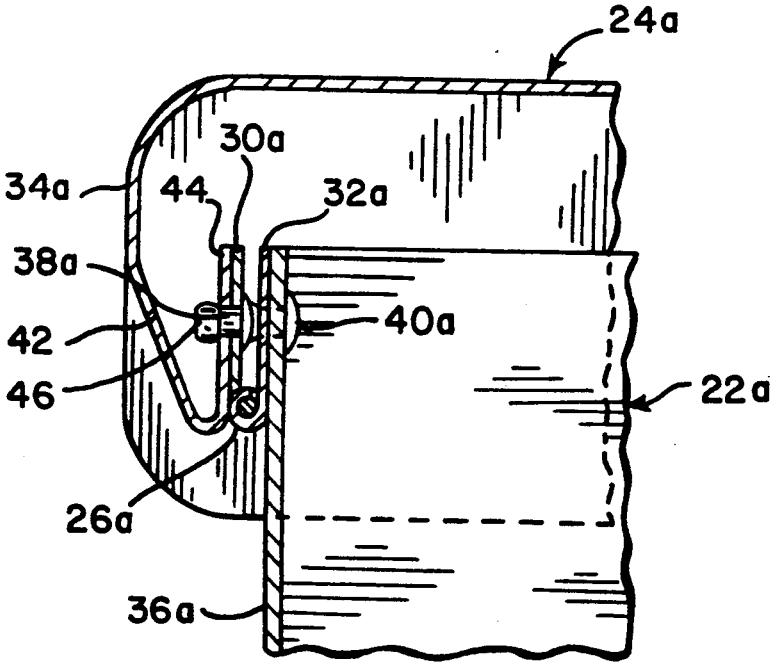
FIG. 6 is a fragmentary cross-sectional view of the inventive storage box taken along line 6—6 in FIG. 5.

In accordance with the invention, there is provided a storage box hinging structure that is resistant to both tampering and rust. More specifically, and as shown in FIGS. 4–6, in order to permit mechanical attachment of the hinge 26a to the cover 24a, and yet provide a box 20a that is tamper resistant, the rear wall 34a of the cover 24a is configured to shield the rivets 38a from exposure along the outside of the box 20a. The rear wall 34a of the cover 24a has a substantially "V" shape, extending downward and inward toward the rear wall 36a of the body 22a of the box 20a to define a first portion (or leg) 42 of the "V", then angling upward and, preferably, substantially parallel to the rear wall 36a of the body 22a of the box 20a to define a second portion (or leg) 44 of the "V". As shown most clearly in FIG. 6, the rivets 38a extend through openings in the outer arm 30a of the hinge 26a and the second leg 44 of the cover rear wall 34a such that the head 46 of each rivet 38a is disposed within the "V". In this way, the rivets 38a are not exposed to the outside of the box 20a, and, therefore, are not easily tampered with.

In a preferred embodiment (see FIG. 6), the first leg 42 of the "V" forms an obtuse angle with the rear wall 34a of the cover 24a, and the angle between the first and second legs 42, 44 of the "V" is acute, being preferably about 30°, whereby the second leg 44 lies substantially parallel to the rear wall 36a of the body when the cover 24a is closed. It will be readily appreciated, however, that in accordance with this invention the second leg 44 of the "V" may be oriented so as to angle away from the rear wall 36a of the body when the cover 24a is closed. Thus, while a preferred embodiment of the invention has the second leg 44 and the rear wall 36a of the body 22a substantially parallel when the cover is closed, an effective hinging structure is possible having a "closed" angle within the range between 0° and 70°. Depending on this desired "closed" angle between the second leg 44 and the rear wall 36a of the body, and depending on the obtuse angle between the first leg 42 of the "V" and the rear wall 34a of the cover, the angle between the first and second legs 42, 44 may vary from 30°, but will preferably fall in the range between about 20° and 45°.

Additionally, it will be appreciated that the rear wall 34a of the cover 24a may be of an alternate design, so long as the heads 46 of the rivets 38a are not exposed to the outside of the box 20a. For example, the first leg 42 of the "V" may be disposed at a right angle or an acute angle to the rear wall 34a, so that the first and second legs 42, 44 form a substantially "U" shaped design. In this way, the rear wall 34a extends downward to define the first side of the "U," the first leg 42 angles inward toward the body 22a of the box 20a to define the base of the "U," and the second leg 44 angles upward to define the second side of the "U." In this way, rivets 38a assembled through an arm 30a of the hinge 26a and the second side of the "U," or the leg 44, would not be accessible from the outside of the box 20a. One skilled in the art will likewise appreciate that the rear wall 34a may be formed in an arcuate shape with no sharp angles. Thus, when the hinge 26a is assembled to the cover 24a, the heads 46 of the rivets 38a will be disposed along the inside surface of the arc.

The unique structure of the cover 24a and hinge mechanism 26a also increase the resistance of the box to elements of foul weather. Returning now to the embodiment illustrated in FIGS. 4–6, it may be seen that the hinge 26a is substantially shielded from access along the rearward side of the box 20a. Further, due to the unique shape of cover 24a along its rear wall 34a, rain and other types of precipitation will run down and off the rear wall 34a and the first leg 42 of the cover 24a, rather than reaching the hinge 26a and adjacent surfaces of the cover 24a and body 22a. Consequently, the box 20a is substantially impervious to rain or other precipitation, although minimal amounts of moisture may enter the box 20a due to capillary action.

It will further be appreciated that, because the components 22a, 24a, 26a are secured together by mechanical devices rather than welding, the components 22a, 24a, 26a may be coated thoroughly with a rust resistant coating prior to assembly. As a result, a box 20a constructed in accordance with the invention will provide superior rust resistance to the prior art storage box 20 discussed above. In a preferred embodiment of the invention, the hinge 26a is made of stainless steel, and the cover 24a and body 22a of the box 20a are coated with a suitable rust resistant material, such as paint or Armor-Tuf TM powder coating (used by the assignee of this application).

The invention provides the additional advantage of presenting an aesthetically pleasing storage box 20a. As shown in FIGS. 5–6 and explained above, the rear wall 34a of the cover 24a may be formed such that it substantially limits the visibility of the hinge 26a from the rear of the box 20a. Additionally, the means for attaching the hinge 26a to the cover 24a are not visible along the rear wall 34a, whereas the dimples from the welds 38 are visible in the prior art storage box 20 (shown in FIGS. 1-3).

In summary, the invention provides a storage box 20a that is both rust and tamper resistant, as well as aesthetically pleasing. The unique "V" shaped design of the rear wall 34a of the cover 24a shields the hinge coupling means from exposure along the outside of the box 20a. Therefore, mechanical elements, such as rivets, may be utilized to secure the hinge 26a to the cover 24a. Because welding is not necessary in conjunction with the hinge structure, the cover 24a and body 22a may be treated with a rust resistant coating along all exposed surfaces prior to assembly, thus making the storage box 20a highly resistant to rust. Furthermore, inasmuch as the cover 24a shields both the rivets 38a and the hinge 26a from external view, the box 20a has a pleasing appearance.

What is claimed is:

1. A hinge structure for a storage container having a body and a cover which is movable between open and closed positions, comprising:

a hinge having first and second pivotable arms, the first arm being fastened to a side wall of the container body, the side wall having an outer side wall surface;

an integral, substantially V-shaped member extending inwardly from a side wall of the cover, said member including at least an outer leg extending directly from the cover side wall and an inner leg bent at an angle to the outer leg, the inner leg having an outer surface;

means for fastening the inner leg of the V-shaped member to the second arm of the hinge, the angle between said inner and outer legs being sufficient to accommodate the fastening means; and a space defined between the outer side wall surface of the body and the outer surface of the inner leg of the V-shaped member of the cover, whereby the hinge is substantially disposed within the space and sandwiched between the outer side wall surface of the body and the outer surface of the inner leg.

2. A hinge structure for a storage container having a body and a cover which is movable between open and closed positions, comprising:

a hinge having a pin and first and second pivotable arms, the first arm being fastened to a side wall of the container body, the side wall having an outer side wall surface;

an integral, substantially V-shaped member extending inwardly from a side wall of the cover, said member including at least an outer portion extending directly from the cover side wall and an inner portion bent at an angle to the outer portion, the inner portion having an outer surface disposed toward the side wall of the body;

means for fastening the inner portion of the V-shaped member to the second arm of the hinge, the angle between said inner and outer portions being sufficient to accommodate the fastening means; and a space defined between the outer side wall surface of the body and the outer surface of the inner portion of the V-shaped member, whereby the hinge is substantially disposed within the space and sandwiched between the outer surface of the inner portion of the V-shaped member and the outer side wall surface of the container body when the cover is in the closed position.

3. The hinge structure of claim 2, wherein the fastening means comprises rivets which extend through the inner portion of the V-shaped member and the second arm of the hinge.

4. The hinge structure of claim 2, wherein the fastening means comprises screws.

5. The hinge structure of claim 2, wherein the angle between the inner and outer portions of the V-shaped member is acute.

6. The hinge structure of claim 5, wherein said angle is approximately 30°.

7. The hinge structure of claim 5, wherein said angle is between 20° and 45°.

8. The hinge structure of claim 2, wherein the body, the cover and the V-shaped member are treated with a rust resistant coating and the hinge is stainless steel.

9. The hinge structure of claim 2, wherein the inner portion of the V-shaped member lies substantially parallel to the body side wall when the cover is closed.

10. The hinge structure of claim 2, wherein the inner portion of the V-shaped member lies at an angle between 0° and 70° to the body side wall when the cover is closed.

11. A storage container comprising:

a body having a side wall, the side wall having an outer side wall surface;

a hinge having a pin and first and second pivotable arms;

means for fastening the first arm to the side wall of the container body;

a cover having a side wall and an integral, substantially V-shaped member extending inwardly from the side wall of the cover, said member including at least an outer portion extending directly from the cover side wall and an inner portion bent at an angle to the outer portion, the inner portion having an outer surface disposed toward the side wall of the body;

means for fastening the inner portion of the V-shaped member to the second arm of the hinge, the angle between said inner and outer portions being sufficient to accommodate the fastening means; and a space defined between the outer side wall surface of the body and the outer surface of the inner portion of the V-shaped member, whereby the hinge is substantially disposed within the space and sandwiched between the outer surface of the inner portion of the V-shaped member and the outer side wall surface of the container body when the cover is in the closed position.

12. The container of claim 11, wherein the fastening means comprises rivets which extend through the inner portion of the V-shaped member and the second arm of the hinge.

13. The container of claim 11, wherein the fastening means comprises screws.

14. The container of the claim 11, wherein the angle between the inner and outer portions of the V-shaped member is acute.

15. The container of claim 14, wherein said angle is approximately 30°.

16. The container of claim 14, wherein said angle is between 20° and 45°.

17. The container of claim 11, wherein the body, the cover and the V-shaped member are treated with a rust resistant coating and the hinge is stainless steel.

18. The container of claim 11, wherein the inner portion of the V-shaped member lies substantially parallel to the body side wall when the cover is closed.

19. The container of claim 18, wherein the inner portion of the V-shaped member lies at an angle between 0° and 70° to the body side wall when the cover is closed.

* * * * *